US009469019B2

(12) United States Patent
Profunser et al.

(10) Patent No.: US 9,469,019 B2
(45) Date of Patent: Oct. 18, 2016

(54) IMPACT WRENCH AND CONTROL METHOD FOR AN IMPACT WRENCH

(75) Inventors: Dieter Profunser, Feldkirch (AT); Peter Brugger, Feldkirch (AT); Jochen Kuntner, Dornbirn (AT)

(73) Assignee: Hilti Aktiengesellschaft, Schaan (LI)

( * ) Notice: Subject to any disclaimer, the term of this patent is extended or adjusted under 35 U.S.C. 154(b) by 1502 days.

(21) Appl. No.: 12/799,174

(22) Filed: Apr. 19, 2010

(65) Prior Publication Data

US 2010/0263890 A1 Oct. 21, 2010

(30) Foreign Application Priority Data

Apr. 20, 2009 (DE) ..... 10 2009 002 479

(51) Int. Cl.
*B25B 21/02* (2006.01)
*B25B 23/14* (2006.01)

(52) U.S. Cl.
CPC ..... *B25B 21/02* (2013.01); *B25B 23/14* (2013.01); *B25B 23/1405* (2013.01)

(58) Field of Classification Search
USPC ..... 173/1, 2, 170, 176, 179, 181; 29/407.02
See application file for complete search history.

(56) References Cited

U.S. PATENT DOCUMENTS

| | | | | |
|---|---|---|---|---|
| 6,167,606 | B1 | 1/2001 | Mueller et al. | 29/407.02 |
| 6,371,218 | B1 * | 4/2002 | Amano et al. | 173/183 |
| 6,945,337 | B2 * | 9/2005 | Kawai et al. | 173/183 |
| 7,334,648 | B2 * | 2/2008 | Arimura | 173/179 |
| 2003/0121685 | A1 * | 7/2003 | Yamamoto | 173/217 |
| 2005/0263304 | A1 * | 12/2005 | Sainomoto et al. | 173/2 |

FOREIGN PATENT DOCUMENTS

| | | |
|---|---|---|
| DE | 195 03 524 | 8/1996 |
| EP | 1 510 394 | 3/2005 |
| EP | 1 695 794 | 8/2006 |
| WO | WO 2007/015661 | 2/2007 |

* cited by examiner

*Primary Examiner* — Nathaniel Chukwurah
(74) *Attorney, Agent, or Firm* — Davidson, Davidson & Kappel, LLC

(57) ABSTRACT

A control method according for an impact wrench includes ascertaining whether the impact wrench applies an impact when the drive shaft rotates in a lower speed range. The speed of the drive shaft then is increased to a higher speed range as a function of an ascertained impact during the rotation in the lower speed range.

13 Claims, 3 Drawing Sheets

IMPACT WRENCH AND CONTROL METHOD FOR AN IMPACT WRENCH

This claims the benefit of German Patent Application DE 10 2009 002 479.4, filed Apr. 20, 2010 and hereby incorporated by reference herein.

The present invention relates to an impact wrench, in particular a tangential impact wrench, and a control method for an impact wrench.

BACKGROUND

A tangential impact wrench periodically, briefly provides a large tightening torque for tightening screw connections or for placing screw anchors. A continuous lesser torque is output at a handle or a holder of the tangential impact wrench, which the user or a stand must counteract.

The tangential impact wrench is suitable for putting screws into manifold materials of varying hardness, for example, into stone, concrete, brick, limestone, and cellular concrete. Screws are typically inserted far enough that the screw head rests on a substrate (workpiece). The screw may not be tightened further, because this results in damage to the screw or the substrate. For example, the screw head may be twisted off, a round hole may be cut into the substrate by the screw thread, or the substrate may be stripped out by the screw thread.

EP 1 510 394 B1 describes an automated shutdown of an impact wrench. The impact wrench monitors the applied tightening torque. If the tightening torque exceeds a threshold value to be set, a primary drive of the impact wrench is shut down.

W0 2007/015661 A2 describes an automated shutdown of an impact wrench, in that a rotational angle of the screw is measured for each impact. If the rotational angle falls below a threshold value, the screw is considered tightened and the impact wrench is shut down.

DE 195 03 524 A1 describes a control method, in which an initial output torque is kept lower than a required torque in order to prevent overtightening of a screw. The torque is subsequently increased step-by-step in an iterative sequence.

EP 1 695 794 A2 describes an estimation unit, which estimates a torque transmitted to a screw.

The known methods require an establishment of a threshold value, which is either permanently predefined or is to be set by a manual worker. In both cases, the risk arises that the threshold value is set inappropriately for a substrate (workpiece).

SUMMARY OF THE INVENTION

An object of the present invention is to provide an impact wrench and a control method for an impact wrench, which makes screwing a screw or another threaded body into a substrate only up to a desired depth easier.

The control method according to the present invention for an impact wrench uses the following steps: establishing an operating mode during a predetermined duration, a drive shaft being rotated in a lower speed range during the predetermined duration, it being ascertained whether the impact wrench applies an impact, and the impact wrench being switched into an operating mode for a soft material, in which a speed of the drive shaft is kept in the lower speed range if impact does not occur in the lower speed range, and the impact wrench being switched into an operating mode for a hard material, for which the speed of the drive shaft is increased to a higher speed range, if impact begins in the lower speed range.

As described, one difficulty when screwing in a screw is that the properties of a substrate are not known or are not sufficiently considered when setting the impact wrench. The described control method indirectly ascertains the properties of the substrate, and the torque output by the impact wrench is set based on the properties.

The method according to the present invention indirectly determines the properties of the substrate via the behavior of the impact mechanism. It has been recognized that the beginning of impact may be correlated with the properties of the substrate. Impact only occurs if a material of the substrate is sufficiently hard. The material must be able to stop the tool or the fastener coupled to the tool, such as a screw, at a low torque, so that a drive of the impact wrench may buffer rotational energy in a buffer. In impact wrenches, two impact bodies are deflected axially to one another against an elastic force if a rotation of the impact bodies may not occur synchronously to the drive due to the material. In the case of a sufficient deflection, the two impact bodies are accelerated toward one another by the elastic force. Due to a design of the impact bodies and optionally a link, at least a part of the kinetic energy is converted into a torque on the substrate upon impact. The initial deflection occurs only if the substrate is capable of sufficiently counteracting the elastic force.

For example, the full power may be provided for a hard substrate, while a low starting power or a low starting torque is maintained for a soft substrate. The screw is screwed in more slowly in accordance with the substrate and the screwing in may be ended upon head contact without substantial overtightening.

The impact wrench according to the present invention contains: a drive shaft, an output shaft, an impact mechanism, in particular a tangential impact mechanism, which couples the drive shaft to the output shaft to transmit a torque, an analysis unit for ascertaining whether the impact mechanism is applying an impact, and a control unit for controlling a speed of the drive shaft as a function of whether impact is ascertained.

Designs of the impact mechanism and the control method are disclosed in the subclaims.

One design provides that a first speed of the drive shaft of the impact wrench and a second speed of an output shaft of the impact wrench are ascertained independently and a deviation of the first speed from the second speed is ascertained as an impact of the impact wrench. The first speed of the drive shaft may be measured or alternatively may be determined from a speed of the primary drive. During the impact operation, the output shaft is only rotated temporarily by the drive shaft, which may rotate continuously.

One design provides that the impact is determined by detection of an acceleration in the impact direction, detection of regular impact noises, and/or by contactless detection of a tangential movement of an impact element of the impact wrench, and a determination of the lower speed includes a detection of the first speed of a drive element and/or a second speed of a tool receptacle of the impact wrench upon the beginning of the impact.

In a refinement, upon occurrence of impact, the speed of the drive shaft is increased to a higher speed range and, if impact does not occur, the speed of the drive shaft is maintained in the low speed range. In soft materials, in which impact does not begin at lower speed, the speed is not to be increased, which favors rapid shutdown. In hard materials, the speed is increased, so that the impact mechanism may provide a high torque.

One design provides that the impact wrench is switched into an operating mode for a soft material if impact does not occur in the low speed range, and the impact wrench is switched into an operating mode for a hard material if impact does not occur in the low speed range. The drive shaft may be rotated for a predetermined duration in the low speed range and the operating mode may be established during the predetermined duration. The operating modes may thus be established when beginning to screw in a screw, for example.

The impact wrench may be a hand-guided machine tool, a supported hand-guided machine tool, or a guided machine tool which is held by a stand.

BRIEF DESCRIPTION OF THE DRAWINGS

The following description explains the invention on the basis of exemplary embodiments and figures.

Identical or functionally identical elements are indicated by identical reference numerals in the figures, unless otherwise specified.

DETAILED DESCRIPTION

Embodiments of control methods for screws are described hereafter for an illustrated impact wrench having a tangential impact mechanism as an example. The described adjustment methods may also be performed using differently designed impact wrenches, however.

Figure 1:
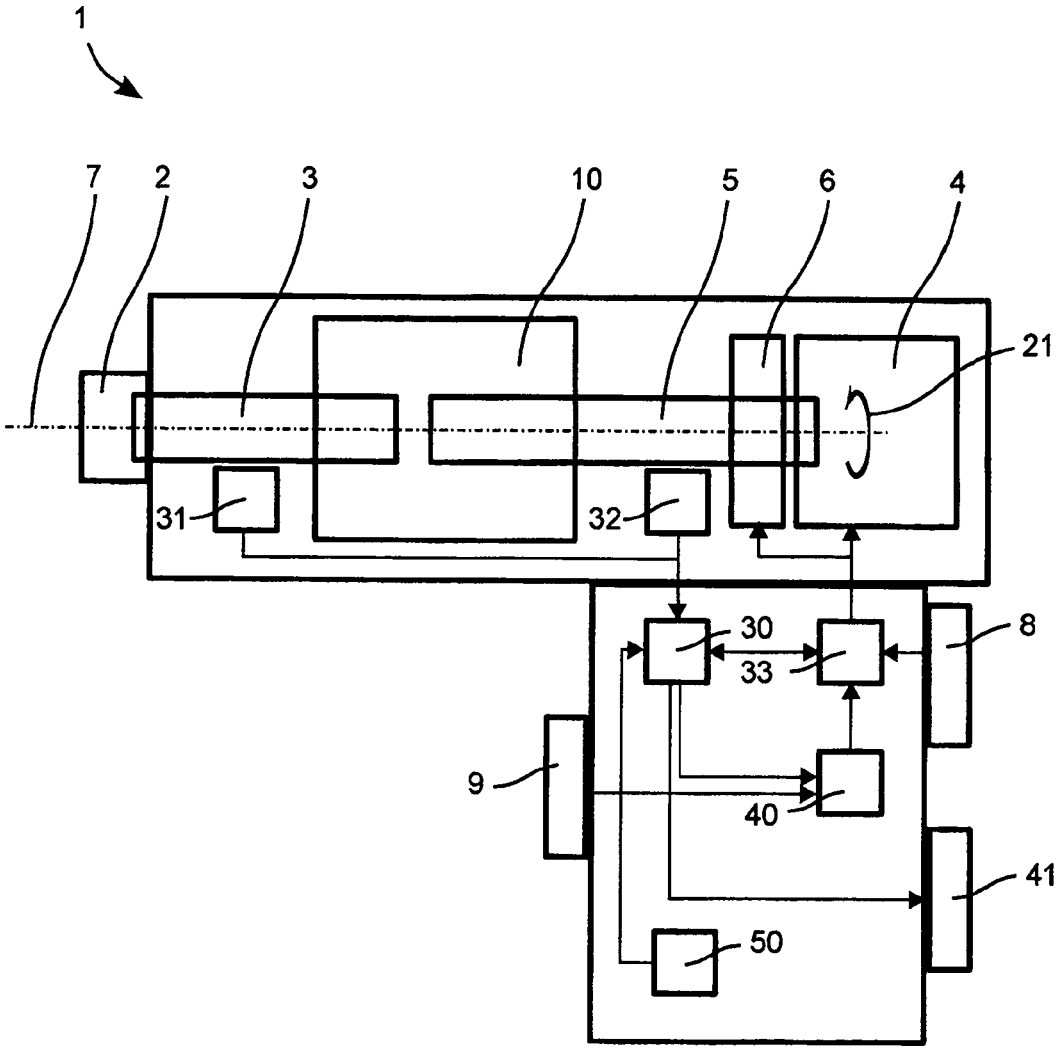
FIG. 1 shows an impact wrench.

FIG. 1 schematically shows a design of an impact wrench 1.

A tool receptacle 2 is driven by an output shaft 3. A primary drive 4 drives a drive shaft 5. Primary drive 4 may be an electric motor, a pneumatic drive, etc. It may be advantageous to interpose a transmission 6 between primary drive 4 and drive shaft 5 to reduce the speed of drive shaft 5. Drive shaft 5 is permanently rotated in a rotational direction 21 around its longitudinal axis 7. The speed of primary drive 4 may be controlled by a motor controller 33. Motor controller 33 contains a rectifier for a brushless electric motor, for example, which is used as primary drive 4. The user may set the speed via an operating element 8. In a special design, it may also be provided that the reduction of transmission 6 is settable by motor controller 33.

An impact mechanism 10 couples drive shaft 5 to output shaft 3. Drive shaft 5 may transmit its torque continuously to output shaft 3 or a torque of drive shaft 5 is used for filling a buffer, which transmits a higher torque to output shaft 3 in periodic impacts, according to situations to be differentiated hereafter.

Figure 2:
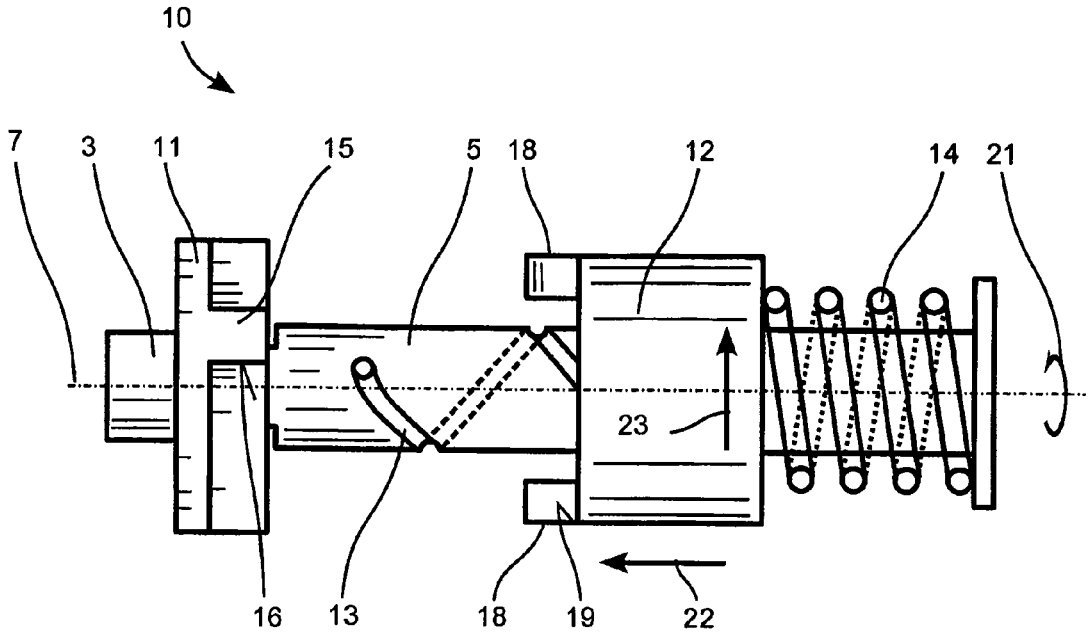
FIG. 2 shows a tangential impact mechanism.

An exemplary impact mechanism 10 is shown in FIG. 2 in longitudinal section. Impact mechanism 10 contains an anvil 11, a rotor 12, a link 13, and a restoring spring 14. Output shaft 3 is mounted rotatably in relation to drive shaft 5 in impact mechanism 10.

Figure 3:
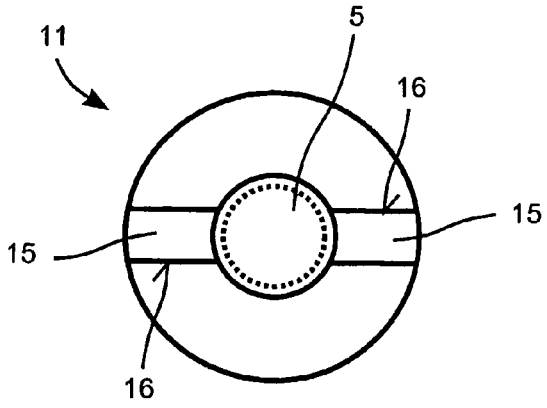
FIG. 3 shows an anvil of the tangential impact mechanism of FIG. 2.

Anvil 11 is connected rotationally fixed to output shaft 3, in such a way that an angular momentum transmitted to anvil 11 acts on output shaft 3. Anvil 11 has one or more projections 15. FIG. 3 shows a top view of anvil 11 viewed from drive shaft 5. Projections 15 may have stop surfaces 16, which are oriented parallel or inclined to longitudinal axis 7.

Rotor 12 is ring-shaped and is pushed onto drive shaft 5. Rotor 12 may move along longitudinal axis 7 guided by drive shaft 5.

Link 13 is implemented on the surface of drive shaft 5. Link 13 coils in a spiral, the coil rising in rotational direction 21 of the drive toward anvil 11. Rotor 12 engages in link 13. As soon as rotor 12 moves along longitudinal axis 7 in direction 22 toward anvil 11, rotor 12 is forced into a rotational movement 23 in relation to drive shaft 5. Rotor 12 is also forced into a movement along longitudinal axis 7 when rotor 12 rotates in relation to drive shaft 5.

At least one hammer 18 is situated on the circumference of rotor 12. Hammer 18 has a lateral stop surface 19, which is implemented as formfitting or at least partially formfitting with stop surfaces 16 of anvil 11. Rotor 12 and anvil 11 may interlock via projections 15 and hammers 18 similarly to a claw clutch or a slip clutch. During the engagement, rotor 12 may transmit its angular momentum or its torque to anvil 11 and drive it.

Restoring spring 14 exerts a force in direction 22 toward anvil 11 on rotor 12. In a starting position of impact wrench 1, rotor 12 is therefore engaged with anvil 11.

The permanent rotation of drive shaft 5 is transmitted via link 13 to rotor 12. As long as rotor 12 may rotate at the same speed, i.e., does not execute a relative rotation to drive shaft 5, it remains in the starting position and is not forced into movement along drive shaft 5. However, in order that rotor 12 may follow the rotation, rotor 12 must also be able to rotate anvil 11, inter alia, against a torque applied by the substrate. The torque applied by the substrate may not fall below a threshold value. The threshold value for the torque is essentially a function of the elastic force of restoring spring 14 against which rotor 12 must be deflected, the pitch of link 13, and optionally the inclination of stop surfaces 16, 19. These variables are predefined by the design of impact mechanism 10. The threshold value may be in the range of 1 Nm to 5 Nm or 2 Nm to 3 Nm.

If the substrate may apply a greater torque, impact mechanism 10 applies an impact. An impact cycle of impact wrench 1 is described hereafter beginning with the starting position. Rotor 12 is engaged with anvil 11. Rotor 12 is prevented by anvil 11 from rotating synchronously with drive shaft 5. Link 13 forces rotor 12 into a movement along longitudinal axis 7, out of the engagement with anvil 11. When rotor 12 is no longer engaged, rotor 12 may rotate relative to anvil 11 and with drive shaft 5. Anvil 11 and hammer 12 come back into a relative position in which they may again interlock. Restoring spring 14 drives rotor 12 back toward anvil 11. Rotor 12 is accelerated in the direction of longitudinal axis 7 in this case. Link 13 forces rotor 12 into a rotational movement 23, whereby rotor 12 receives an angular momentum. Rotational movement 23 is stopped by the lateral stop of hammer 18 of rotor 12 on projections 15 of anvil 11. The angular momentum of rotor 12 is transmitted to anvil 11. The system is again in the starting position and a new impact cycle begins.

During one impact cycle, anvil 11 and output shaft 3 rotate around a smaller angle than rotor 12 and drive shaft 5. Rotor 12, driven by drive shaft 5, rotates along link 13 and anvil 11 remains stationary. During the impact of impact mechanism 10, a speed of drive shaft 5 therefore differs from a speed of output shaft 3. The speed of drive shaft 5 may be more than twice as great as the speed of output shaft 3. If anvil 11 and rotor 12 remain engaged in a non-impact operation, drive shaft 5 and output shaft 3 are rigidly coupled. Their respective speeds are equal. An impact cycle may be discriminated from a non-impact operation on the basis of the different speeds occurring during it.

An analysis unit 30 and units 31, 32 (FIG. 1) for determining the speed of output shaft 3 and drive shaft 5 are provided for a detection of an impact. Analysis unit 30 compares the determined speeds of output shaft 3 and drive shaft 5. If the two speeds differ, typically by a factor greater than two, analysis unit 30 recognizes this as an impact operation, otherwise it is a non-impact operation.

The speed of output shaft 3 is determined by a speed sensor 31. Speed sensor 31 may detect the speed optically or magnetically, for example. An optical speed sensor may detect markings on output shaft 3 in reflection or via a light barrier. The markings may be formed by projections, depressions, holes, ink, etc. Output shaft 3 may have a non-circular cross section, for example, an elliptical, square, or toothed cross section. A magnetic speed sensor detects a periodically changing magnetic flux due to rotating output shaft 3.

The speed of drive shaft 5 may also be determined via a speed sensor 32. Alternatively, analysis unit 30 communicates with a motor controller 33 to request or receive the instantaneous speed of primary drive 4. Analysis unit 30 may determine the speed of drive shaft 5 from the requested speed of primary drive 4 and, if present, the reduction of transmission 7.

An exemplary control method for impact wrench 1 will be explained on the basis of the flow chart in FIG. 4.

A user operates system switch 9 of impact wrench 1 in order to screw in a screw. A sensor detects the operation of system switch 9. A control unit 40 of impact wrench 1 is activated. In a first phase S1, control unit 40 instructs motor controller 33 to accelerate a speed N of drive shaft 5 to a lower speed N1 within a lower speed range.

The lower speed range may be in the range of 10% to 50%, for example, at least 20% and at most 40%, of rated highest speed Nmax of drive shaft 5. Lower speed N1 may be permanently predefined. Alternatively, an operating element 8 may be provided, which allows the user to set lower speed N1, for example, in the range of 10% to 50% of rated highest speed Nmax of drive shaft 5.

In a second phase S2, lower speed N1 of drive shaft 5 is maintained for a predefined time span T1. A screw or an anchor is screwed in at lower speed N1 during time span T1. Time span T1 may be measured in seconds, or may be established indirectly via a number of rotations of anvil 11 or a screwing depth.

During or following second phase S2, it is checked whether impact mechanism 10 applies an impact or whether it does not apply an impact (S3). For this purpose, lower speed N1 of drive shaft 5 may be compared to a speed M of output shaft 3. Speed M may be determined during or following second phase S2. If the two speeds differ, it is an impact operation. The analysis of the speeds and the check as to whether it is an impact or a non-impact operation may be performed by analysis unit 30. Alternatively, the presence of an impact may be ascertained on the basis of impact noises, acceleration values typical for impact, etc.

Second phase S2 may also be ended before expiration of time span T1, if an impact has already been detected. Analysis unit 30 may transmit a corresponding trigger signal to control unit 40 to end second phase S2.

If an impact is detected during second phase S2, analysis unit 30 instructs control unit 40 to drive impact mechanism 10 via primary drive 4 according to a sequence for a hard substrate (S4). Otherwise, the control unit is to drive impact mechanism 10 according to a sequence for a soft substrate (S5). Both sequences S4, S5 are described hereafter.

Sequence for a soft material S5 firstly provides leaving speed N of drive shaft 5 at lower speed N1 in a third phase S6. The exemplary screw is thus just screwed in.

In one design, analysis unit 30 monitors whether an impact begins (S7) during third phase S6. For example, a substrate may exert a higher torque on anvil 11 because of a screw which is screwed in more deeply or because of harder layers below the surface.

If an impact is detected, analysis unit 30 instructs control unit 40 to increase the speed to a moderate speed N2 in the moderate speed range in a fourth phase S8. The moderate speed range may be between 35% and 75% of rated highest speed Nmax, for example, at least 50% and at most 60%. Low speed N1 may differ from moderate speed N2 by a factor of 2 to 10, for example, 2 to 3.

In fourth phase S8, analysis unit 30 may monitor the impact behavior further. As soon as stopping of the impact is detected, analysis unit 30 may instruct control unit 40 to drive the impact mechanism according to third phase S6 again.

Primary drive 4 is shut down from third phase S6 and fourth phase S8 if the screw is detected as screwed in. This may be performed by manifold methods. For example, speed N of drive shaft 5 or speed M of output shaft 3 may be monitored. During the monitoring, an expected speed Navg or Mavg is ascertained, which may be speeds occurring as an average value in a prior interval, for example. As soon as the screw is screwed in and the head presses against the substrate, the torque to be applied increases suddenly. As a result, speed N or M drops. In the event of detection of such a drop of approximately 20% to 50% of current speed N or M in relation to expected speed Navg or Mavg, primary drive 4 is deactivated.

The sequence for a hard material S4 provides a fifth phase S9. The speed of drive shaft 5 is accelerated to a high speed N3 in a high speed range. The high speed range is between 50% and 100% of rated highest speed Nmax, for example, at least 75%. Control unit 40 drives impact mechanism 10 so that it outputs a maximum torque.

In one design, analysis unit 30 further monitors whether the impact stops (S10). If the impact stops, control unit 40 changes to second phase S2. At low speed N1 it may be checked once again whether the screw has penetrated into a soft material.

A shutdown from fourth phase S9 may be performed as a function of the development of speed M of output shaft 3. The speed of output shaft 3 is a measure of the torque which must be applied to rotate the screw. The higher the required torque, the smaller the angle around which output shaft 3 may be rotated with each impact. If speed M changes more rapidly than a predefined rate of change and/or if the speed changes more rapidly than a mean detected rate of change Mavg, primary drive 4 is stopped. It is assumed that the change is caused by a contact of the screw head on the substrate. The rate of change describes the change in the speed over time. It may be recorded and its mean value may be determined.

In a further design, a sixth phase S11 is provided, which the sequence changes to if speed M of output shaft 3 falls below a lower threshold value Mmin. Sixth phase S11 is provided for the case in which impact wrench 1 is operated at its load limit. The speed is increased to highest possible speed Nmax, N4. Sixth phase S11 also differs from fifth phase S9 by the shutdown behavior. Instead of a comparison of the prior behavior of speed Mavg or Navg, primary drive 4 is shut down as soon as speed M of output shaft 3 falls below a second lower threshold value. Alternatively, primary drive 4 may be shut down if the speed remains below lower threshold value Mmin for a predefined time span, after the speed was increased to Nmax.

Figure 4:
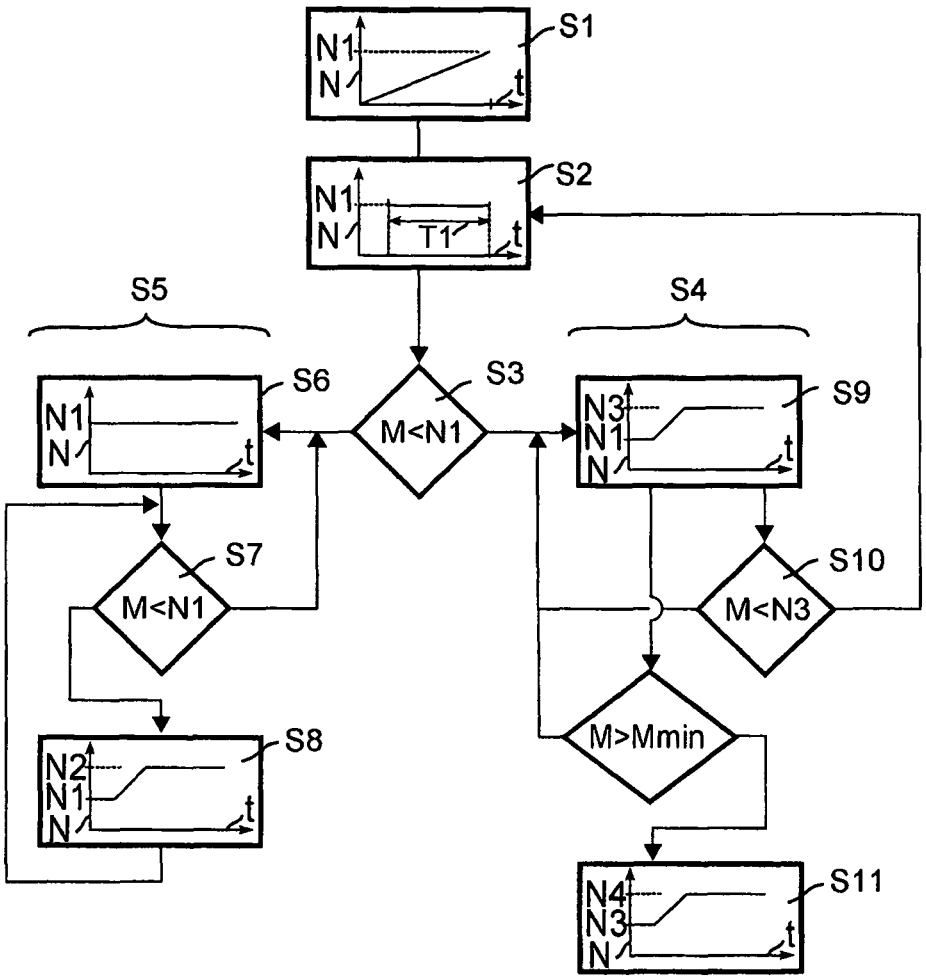
FIG. 4 shows a flow chart of a control method.

In order to keep the flow chart clear, the stop conditions for a shutdown of the primary drives are not shown in FIG. 4. These may be checked with higher priority than all other functions in one design, in order to ensure a rapid shutdown.

A refinement provides a boost function. After shutdown of primary drive 4, the position of operating switch 9 is monitored. If operating switch 9 is held pressed down for a predefined time span, primary drive 4 is reactivated according to first phase S1. Control unit 40 begins again with the sequence according to one of the preceding embodiments.

A further design provides error detection. If a screw is overtightened, the torque with which the screw opposes drive shaft 3 decreases. The speed of drive shaft 3 increases, at least in the impact range. Analysis unit 30 may monitor the speed and output a warning message in the event of a rise of the speed of drive shaft 3. The warning message may be transmitted to a display element 41 for display to a user. The display element may output a warning visually or acoustically.

In the preceding embodiments, reference was made to the analysis of the speeds of output and drive shafts 3, 5 for the determination of whether an impact operation or a non-impact operation is provided. Alternatively or additionally, impact noises, accelerations in the axial direction, and an axial movement of rotor 12 may be detected and used for the analysis. A corresponding sensor 50 may be provided for this purpose.

Speed sensors 31, 32 may detect the speeds in analog or digital form. Analysis unit 30 may also include an analog comparison stage for comparing the speeds of drive shaft 5 and output shaft 3.

What is claimed is:

1. A control method for an impact wrench, comprising the steps of:

rotating a drive shaft within a low speed range;

ascertaining whether the impact wrench is in an impact or non-impact operation mode during the low speed range; and if the non-impact operation mode is ascertained, switching the impact wrench into an operating mode for a soft material, in which a speed of the drive shaft is maintained in the low speed range, if the impact operation mode is ascertained, switching the impact wrench into an operating mode for a hard material, for which the speed of the drive shaft is increased to a higher speed range.

2. A control method for an impact wrench, comprising the steps of:

establishing an operating mode during a predetermined duration, a drive shaft being rotated in a low speed range during the predetermined duration;

ascertaining whether the impact wrench applies an impact; and if impact does not occur in the low speed range, switching the impact wrench into an operating mode for a soft material, in which a speed of the drive shaft is maintained in the low speed range, if impact begins in the low speed range, switching the impact wrench into an operating mode for a hard material, for which the speed of the drive shaft is increased to a higher speed range.

3. The control method as recited in claim 2 wherein a first speed of the drive shaft of the impact wrench and a second speed of an output shaft of the impact wrench are ascertained independently, and a deviation of the first speed from the second speed is ascertained as the impact of the impact wrench.

4. The control method as recited in claim 2 wherein at least one of (a) an acceleration in the impact direction, (b) regular impact noises, and (c) a tangential movement of an impact body of the impact wrench is detected to ascertain the impact of the impact wrench.

5. The control method as recited in claim 2 wherein the predetermined duration begins with an operation of a system switch of the impact wrench or with reaching a target speed within the low speed range.

6. The control method as recited in claim 2 wherein an output shaft of the impact wrench is rotationally fixed to an anvil, and a rotor is driven by the drive shaft, and when impact does not occur in the low speed range the anvil and the rotor remain engaged so that the drive shaft and output shaft are rigidly coupled.

7. An impact wrench comprising:

a drive shaft;

an output shaft;

an impact mechanism coupling the drive shaft to the output shaft to transmit a torque;

an analysis unit for ascertaining whether the impact mechanism applies an impact; and a control unit to establish an operating mode during a predetermined duration via rotation of the drive shaft in a low speed range and to respond to an ascertainment by the analysis unit as to whether the impact wrench applies an impact, an operating mode for a soft material having a speed of the drive shaft in a low speed range being established if impact does not occur in the low speed range, or an operating mode for a hard material having a speed of the drive shaft in a higher speed range being established if impact in the low speed range does occur.

8. The impact wrench as recited in claim 7 further comprising a first speed sensor for detecting a first speed of the drive shaft or a motor, and a second speed sensor for detecting a second speed of the output shaft, the analysis unit comparing the first and second speeds to ascertain the impact.

9. The impact wrench as recited in claim 7 further comprising an impact sensor for detecting an impact, the impact sensor including an acceleration sensor for detection of an acceleration in the impact direction, a sound transducer for detection of regular impact noises, and/or a movement sensor for contactless detection of a tangential movement of an impact element of the impact wrench.

10. The impact wrench as recited in claim 7 wherein the impact mechanism is a tangential impact mechanism.

11. The impact wrench as recited in claim 7 further comprising an anvil rotationally fixed to the output shaft, and a rotor driven by the drive shaft, the anvil and the rotor remaining engaged so that the drive shaft and output shaft are rigidly coupled when impact does not occur.

12. The control method as recited in claim 1 further comprising accelerating the drive shaft into the low speed range during a first time period, and the rotating of the drive shaft including maintaining the low speed range for a second time period.

13. The control method as recited in claim 1 wherein an output shaft of the impact wrench is rotationally fixed to an anvil, and a rotor is driven by the drive shaft, and in the non-impact operation mode the anvil and the rotor remain engaged so that the drive shaft and output shaft are rigidly coupled.

* * * * *